US011673724B2

(12) United States Patent
Wendle

(10) Patent No.: US 11,673,724 B2
(45) Date of Patent: Jun. 13, 2023

(54) RELEASABLE BUNDLING TIE

(71) Applicant: Todd B. Wendle, Hope, ID (US)

(72) Inventor: Todd B. Wendle, Hope, ID (US)

( * ) Notice: Subject to any disclaimer, the term of this patent is extended or adjusted under 35 U.S.C. 154(b) by 0 days.

(21) Appl. No.: 17/487,957

(22) Filed: Sep. 28, 2021

(65) Prior Publication Data

US 2022/0177206 A1 Jun. 9, 2022

Related U.S. Application Data

(60) Provisional application No. 63/057,776, filed on Jul. 28, 2020.

(51) Int. Cl.
*B65D 63/10* (2006.01)

(52) U.S. Cl.
CPC .... *B65D 63/1027* (2013.01); *B65D 2563/105* (2013.01); *B65D 2563/107* (2013.01)

(58) Field of Classification Search
CPC ..... B65D 63/1027; B65D 2563/105; B65D 2563/107; Y10T 24/1498
See application file for complete search history.

(56) References Cited

U.S. PATENT DOCUMENTS 3,072,986 A * 1/1963 Lefnaer ..... B65D 63/18 292/307 R
3,530,543 A * 9/1970 Desmarais ..... G09F 3/14 40/668
3,780,400 A * 12/1973 Hinsperger ..... A44B 1/185 D8/394
5,311,690 A * 5/1994 Batten ..... G09F 3/14 40/655
6,581,250 B2 * 6/2003 Matsushima ..... A44B 13/007 24/130
6,640,393 B2 * 11/2003 Wendle ..... B65D 63/18 24/17 AP

* cited by examiner

*Primary Examiner* — Robert Sandy

(57) ABSTRACT

Improved releasable bundling ties having unique releasable locks are provided. In various embodiments, the releasable locks have a two-way operation, wherein a bundling tie can be fastened or locked in either one or both of two directions.

20 Claims, 7 Drawing Sheets

RELEASABLE BUNDLING TIE

PRIORITY CLAIM AND CROSS-REFERENCE TO RELATED APPLICATION

This application claims the benefit under 35 U.S.C. § 119(e)(1) of U.S. Provisional Application No. 63/057,776, filed Jul. 28, 2020, which is hereby incorporated by reference in its entirety.

BACKGROUND

Various tie devices have been developed for the purpose of binding or bundling cables, wires and the like for storage or transport. Many of the presently available ties are for single use and are self-locking. That is, the loop formed by the tie is permanent and cannot be broken without destroying the tie.

It is also known to provide a re-usable form of cable tie, in which a flexible strap of substantially rectangular cross-section is provided with serrated or otherwise formed sides or edges that are receivable within and lock with a slotted end of the tie. Such ties can be useful but in a limited way because they form only a single useful loop when in use. Other similar strap ties solve this problem by including provisions for a second loop, but make use only of the single set of serrated edges to enable formation of both loops. This limits use or adjustability of the tie.

Bundling ties that are adjustable or releasable include those that are disclosed in U.S. Pat. Nos. 6,640,393 and 6,961,979 to Wendle, which are herein incorporated in their entirety. However, the bundling ties discussed therein can be subject to unintentional loosening or unlocking due to the limitations of the locking mechanisms used.

BRIEF DESCRIPTION OF THE DRAWINGS

The detailed description is set forth with reference to the accompanying figures. In the figures, the left-most digit(s) of a reference number identifies the figure in which the reference number first appears. The use of the same reference numbers in different figures indicates similar or identical items.

For this discussion, the devices and systems illustrated in the figures are shown as having a multiplicity of components. Various implementations of devices and/or systems, as described herein, may include fewer components and remain within the scope of the disclosure. Alternately, other implementations of devices and/or systems may include additional components, or various combinations of the described components, and remain within the scope of the disclosure. Shapes and/or dimensions shown in the illustrations of the figures are for example, and other shapes and or dimensions may be used and remain within the scope of the disclosure, unless specified otherwise.

DETAILED DESCRIPTION

Overview

Figure 1A:
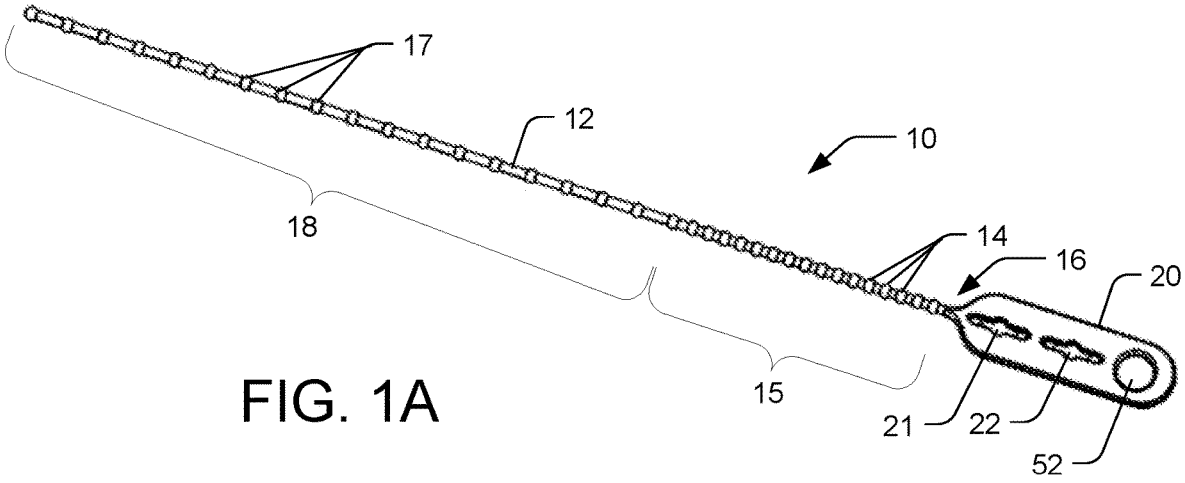
FIG. 1A is a prospective view of an example releasable bundling tie, according to a first embodiment.

Representative implementations of devices and techniques provide improved releasable bundling ties having unique releasable locks. In various embodiments, including those illustrated herein, the releasable locks have a two-way operation, wherein a bundling tie can be fastened or locked in either one or both of two directions. In the embodiments, each of multiple locking slots on a releasable bundling tie can include at least two locking positions, which may be oriented 180 degrees relative to each other in some embodiments. In alternative implementations, each locking slot may include two or more locking positions, which locking positions may be arranged in various orientations and at various angles relative to each other.

The presence of multiple locking slots, and the unique multi-lock configuration of each locking slot provides the user a variety of locking positions to select from, optimizing the functionality of the bundling tie. Double locking positions (or multiple locking positions) at each locking slot allows the strand of the bundling tie to be locked in a first direction or a second direction (or a first direction and then a second direction) as desired, or depending on the forces that will be exerted from the object being contained, wrapped, or bundled.

For one example, the strand of the bundling tie can be locked in the same direction that corresponds to the vector of the forces being put on the strand (and particularly the portion of the strand secured at the lock) as the bundled object strains to unbundle (think a sleeping bag, for instance). That unbundling force can be used to prevent the bundling tie from unlocking, pushing the strand of the bundling tie into the lock. In another example, the strand of the bundling tie can be locked in the same direction as the hanging weight of the bundled object. In either case, the forces acting on the strand and the locking mechanism of the releasable bundling tie can tend to reinforce the locked orientation of the strand rather than to loosen or to unlock the bundled object.

In an additional example, the unique lock configuration allows the strand of the bundling tie to be locked in a first direction, and if the strand is jarred loose from its locked position, the strand will immediately lock in an opposite direction due to the jarring forces. Further, the strand may be double-locked when desired, by locking the strand in a first direction, possibly wrapping the strand around a portion or all of the bundled object, and locking the strand in the opposite direction (either in the same locking slot or in another locking slot). In other words, the advantages of each locking slot having at least two locking positions include that the number of available locking positions is multiplied, as well as providing locking positions that accommodate the forces that can act on the bundling tie in various bundling and storage applications.

EXAMPLE EMBODIMENTS

As shown at FIGS. 1A-7, in various embodiments, a releasable bundling tie (hereinafter "tie") 10 is provided in which at least one elongated strand 12 of flexible material is included. A first set of three-dimensional (3D) beads 14 is disposed along the strand 12 and the beads 14 are spaced apart along a first strand length 15. A second set of 3D beads 17 is also disposed on the strand 12 and the beads 17 are spaced apart along a second strand length 18. The beads 14 of the first length 15 may be spaced closer together than the beads 17 of the second length 18, for finer adjustability at the first length 15. Alternately, the beads 14 and the beads 17 may be spaced apart similarly or equally.

A tab 20 is disposed at one end of the strand 12 (which may be near the first length 15, for example) and includes at least a first locking slot 21 and a second locking slot 22. Each slot 21 and 22 is shaped to releasably receive the first length 15 or the second length 18 of the strand 12, and to interlock with the strand 12 and the beads 14 or the beads 17 (see FIG. 7 for detail). The beads 14 and 17 may have the same shape or a similar 3D shape and size to fit within an opening portion 32 of the locking slots 21 and 22, which opening portion 32 may also have the same or similar shape and size. Alternately, the beads 14 and 17 may be sized differently from each other, and correspond to unequal sizes of openings 32 in locking slots 21 and 22 (thereby keying a set of beads to a locking slot, for example). Further, the tab 20 may include additional locking slots as well.

Referring to the drawings, it will be seen that three variations of an example tie 10 are illustrated herein (other variations are also possible in other embodiments not illustrated). FIGS. 1A-2C are illustrative of a first embodiment of the tie 10 whereas FIGS. 3-4C and FIGS. 5-6C show additional embodiments that may have additional features. For instance, the embodiment illustrated in FIGS. 5-6C includes an accessory handle 52. Aside from these added features, the remaining portions of the tie 10 may be common to all three versions and will be described using the same reference numerals.

In various embodiments, the tie 10 is formed of an elongated length of flexible material such as a polymer or plastic, and may have various cross-sectional shapes. The tie 10 is flexible in that it can bend, including bending in a relatively tight radius (e.g., a radius of fractions of an inch in some implementations). Injected molded nylon is one example material that may be used to form the tie 10, but other materials having relatively high tensile strength and relative flexibility could be used as well (such as various polymers, composites, natural and man-made materials).

Figure 1B:
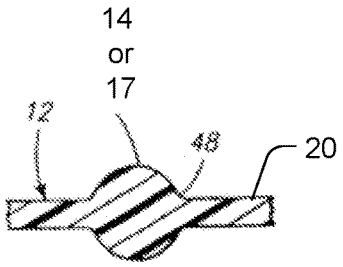
FIG. 1B shows a section view of the example releasable bundling tie of FIG. 1A, according to the embodiment.

FIG. 1B shows a sectional view of the strand 12 and an example bead 14 or 17 of the example tie 10. The section view shows a cut across (or normal to) the primary (length) axis of the tie 10. As shown at FIG. 1B, the beads 14 and/or 17 can be integrated into the strand 12 of the tie. For example, the beads 14 and/or 17 may be molded as part of the strand 12, during formation of the strand 12. In other words, in some implementations, the beads 14 and/or 17 are an integral part of the strand 12. In other implementations, the beads 14 and/or 17 may be added to the strand 12 after formation of the strand 12. In that case, the beads may be formed of a same or a different material than the strand 12 (e.g., plastics, composites, metals, etc.).

The bead 14 and/or 17 illustrated in FIG. 1B is typical of the remaining beads 14 and/or 17 along the length of the strand 12. The illustrated bead 14 and/or 17 is joined integrally with the strand 12 with integral fillets 48 at each juncture. The beads 14 and/or 17 and fillets 48 add strength to the strand 12. It should be understood that the beads 14 and/or 17 are immovable along the length of the strand 12 (e.g., fixed in their respective positions relative to the strand 12). Further, the beads 14 and/or 17 can help to secure a load or bundle by engaging a portion of the load or bundle, based on the shape of the beads 14 and/or 17. For instance, the beads 14 and/or 17 may grip portions of a load or bundle by depressing into the material of the load or bundle, and/or by engaging a portion of the load or bundle.

In various embodiments, the tab 20 comprises a flattened portion of the tie 10 that is integral with the strand 12. For example, the tab 20 is formed of a same material, and may be formed during formation of the strand 12. Alternately, the tab 20 may be added to (coupled to) the strand 20. In that case, the tab 20 may be formed of a same or a different material than the strand 12 (e.g., plastics, composites, metals, etc.). In some embodiments, a hanger aperture 52 is provided in the tab 20 to facilitate hanging of the tie 10 and any attached bundle or load.

It is noted that the form illustrated in the figures shows the tab 20 as being situated at an end of the strand 12 near the first strand length 15 (and opposite the remaining strand length 18). However, it is conceivable that the tab 20 could be positioned at a different location along the strand 12. For example, it is possible that the tab 20 could be situated between the first strand length 15 and the second strand length 18, or at the end of the second strand length 18.

It is also possible that the two sets of beads 14 and 17 could be formed along separate portions of the tie 10. For example, the second strand length 18 could be mounted in one position integrally with the tab 20, and the first length 15 could be a separate part, and be integrally connected to the tab 20 as well. In other words, the two strand lengths 15 and 18 may not necessarily be coaxial with one another or be formed along a single strand 12.

Figure 2A:
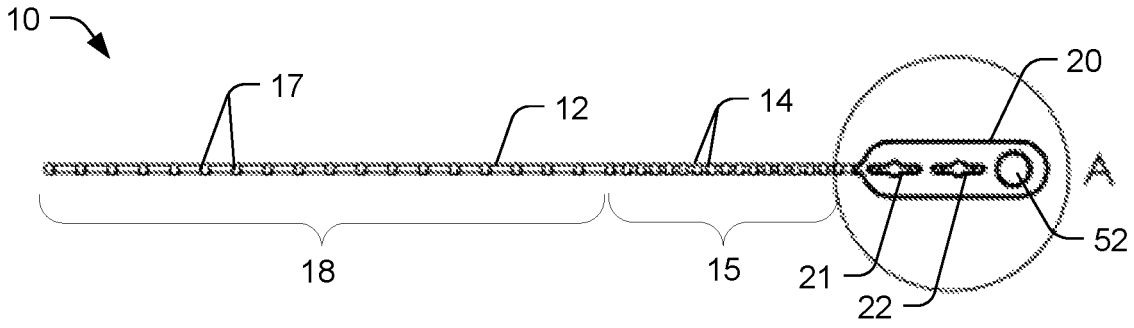
FIG. 2A shows a front plan view of the example releasable bundling tie of FIG. 1A, according to the embodiment.
Figure 2B:
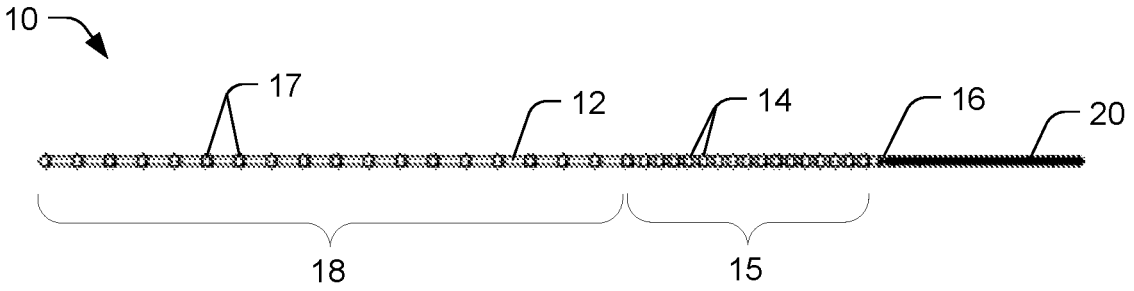
FIG. 2B shows a side view of the example releasable bundling tie of FIG. 1A, according to the embodiment.
Figure 2C:
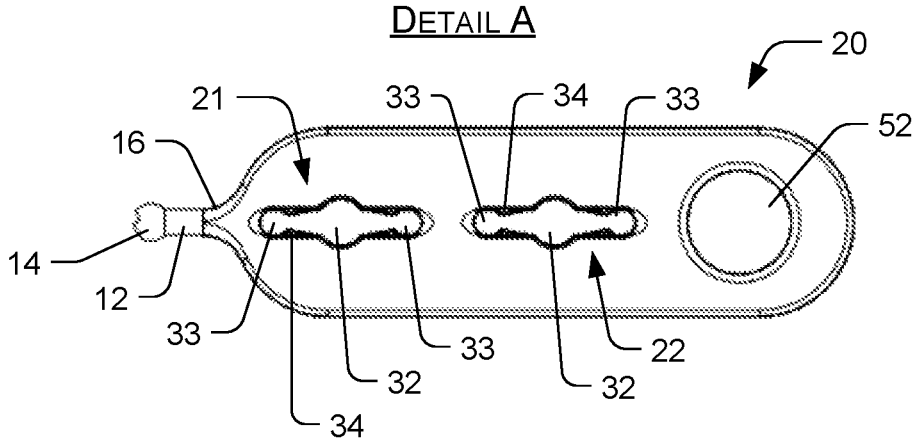
FIG. 2C shows a detail view of a portion of the example releasable bundling tie of FIG. 1A, according to the embodiment.
Figure 3:
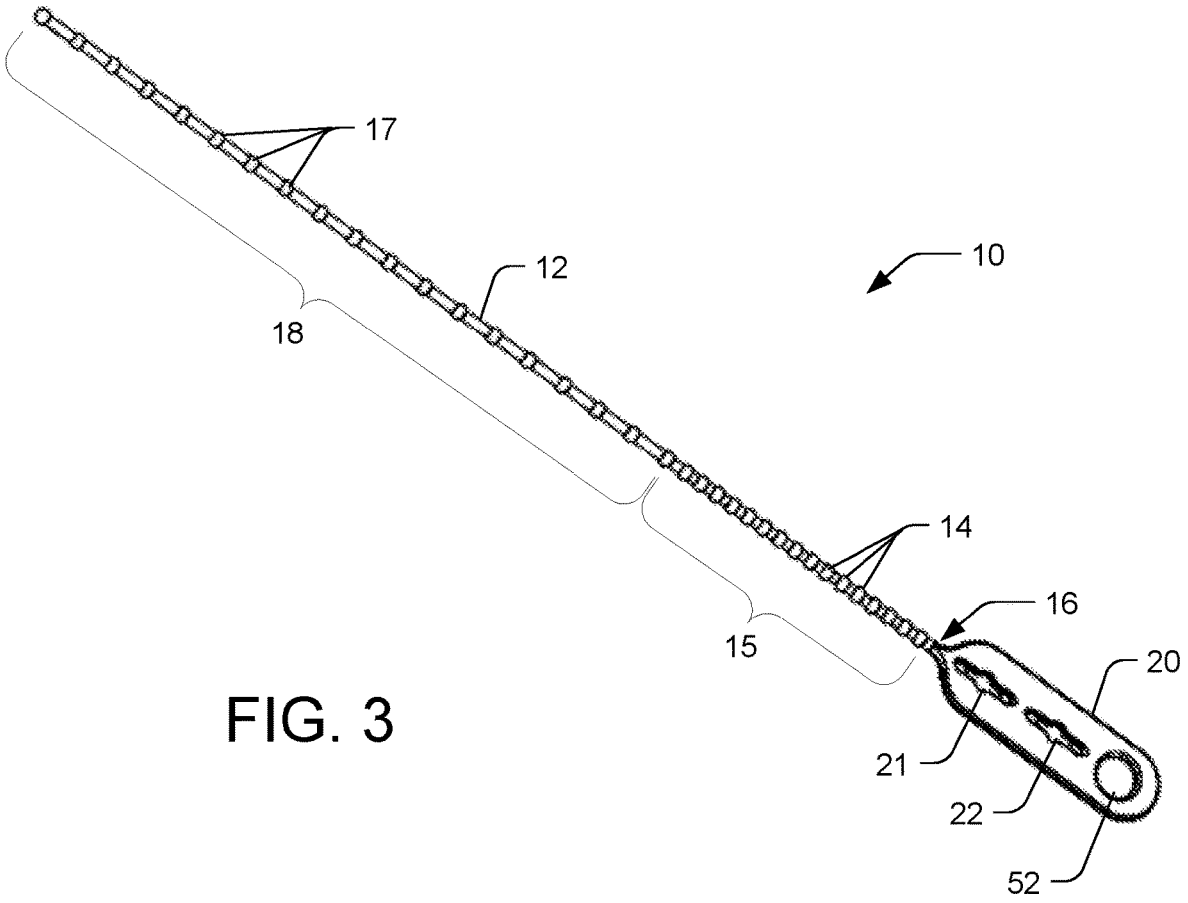
FIG. 3 is a prospective view of an example releasable bundling tie, according to a second embodiment.
Figure 4A:
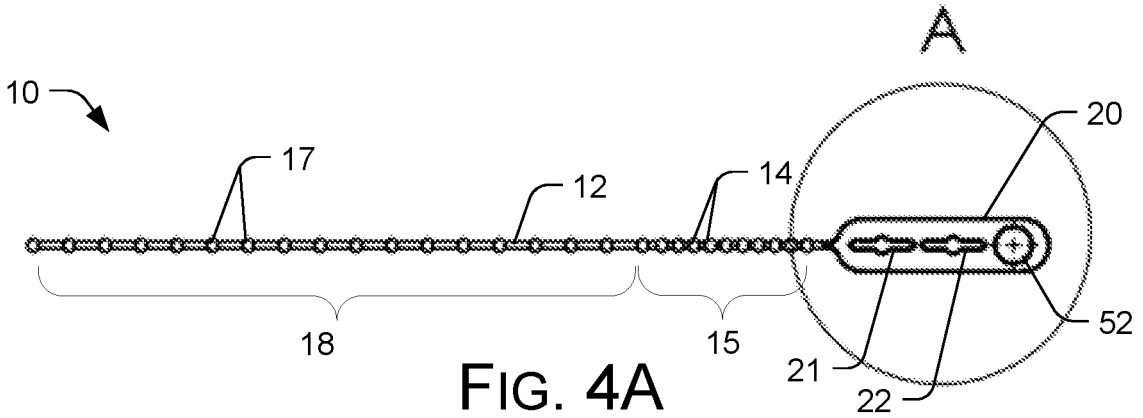
FIG. 4A shows a front plan view of the example releasable bundling tie of FIG. 3, according to the embodiment.
Figure 4B:
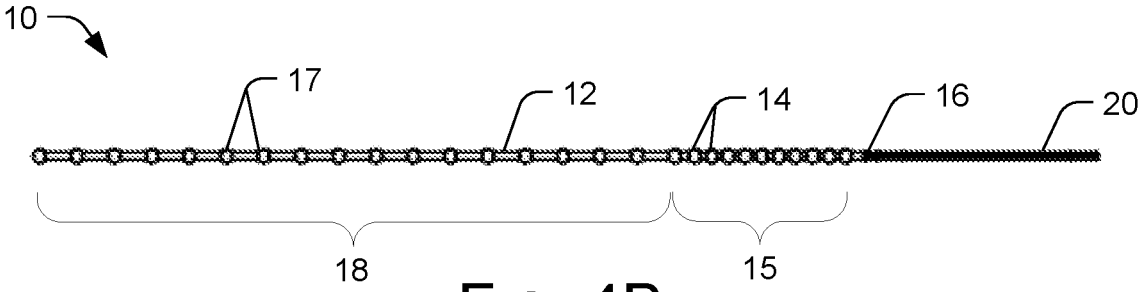
FIG. 4B shows a side view of the example releasable bundling tie of FIG. 3, according to the embodiment.
Figure 4C:
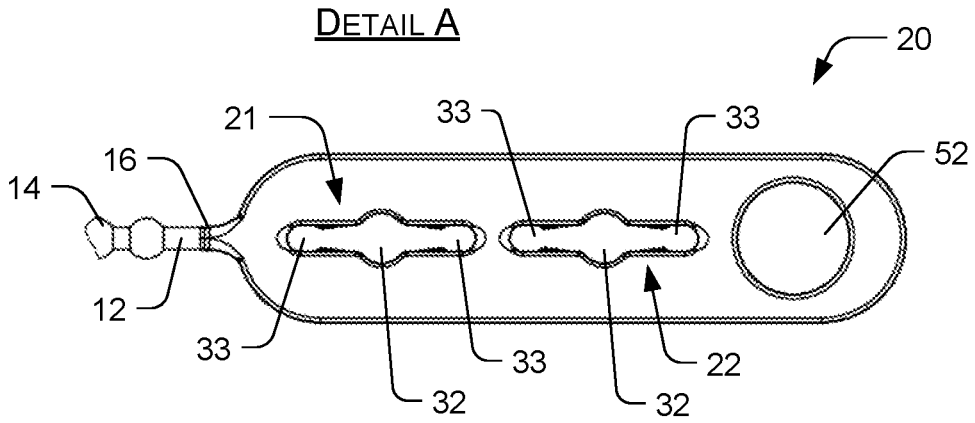
FIG. 4C shows a detail view of a portion of the example releasable bundling tie of FIG. 3, according to the embodiment.
Figure 5:
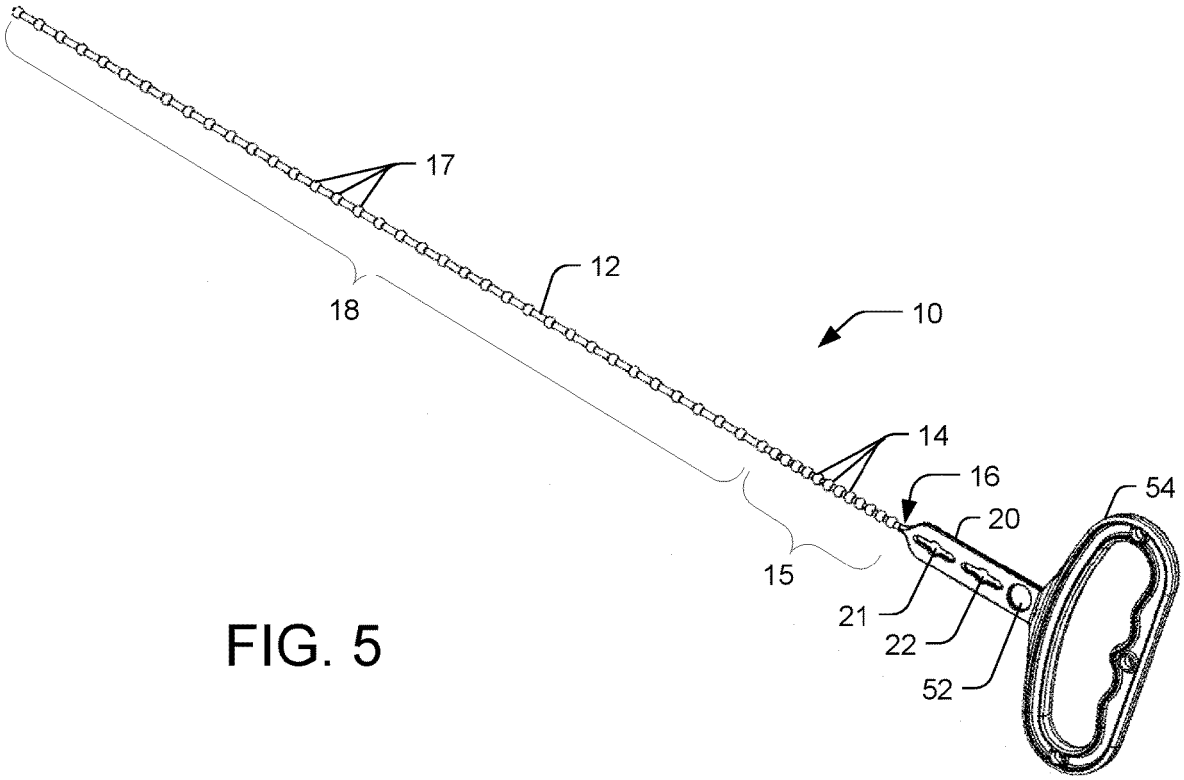
FIG. 5 is a prospective view of an example releasable bundling tie, according to a third embodiment.
Figure 7:
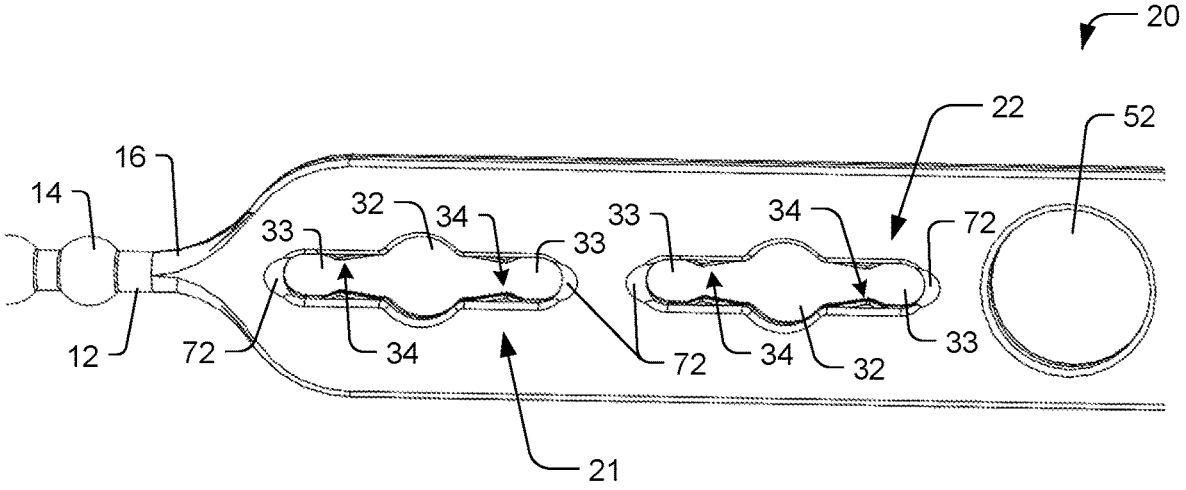
FIG. 7 is a detail view of the tab section of an example releasable bundling tie, according to various embodiments.

Referring particularly to FIG. 2C and FIG. 7, the tab 20 may include a tapered reinforcement portion 16 that gradually or progressively reduces the size and shape of the tab 20 to the size and shape of the strand 12 at the junction of the tab 20 and the strand 12. For instance, where the tab 20 comprises a larger planar portion, with a generally rounded rectangular shape, and where the strand 12 comprises a much smaller diameter rod, the reinforcement portion 16 gradually tapers the shape of the tab 20 to match the shape of the strand 12. Rather than having a potentially weak spot at the junction of the tab 20 and the strand 12, the reinforcement portion 16 can provide a stronger junction, which may be effective in preventing the tab 20 from breaking from the strand 12 at the junction. In embodiments where the tab 20 includes a rim or border around the perimeter of the tab 20, the reinforcement portion 16 blends the rim or border of the tab 20 into the rod-shape of the strand 12, as shown at FIGS. 2C and 7, for additional support.

As shown in the drawings, the tab 20 includes the first and second locking slots 21 and 22, respectively. In alternate embodiments, the tab 20 may include additional locking slots. Detail of the locking slots 21 and 22 can be seen at FIGS. 2C, 4C, 6C, and particularly at FIG. 7. Alternately, locking slots 21 and 22, or additional locking slots, may have a slightly different orientation or configuration, while retaining the basic components and operation as described herein.

In various embodiments, the first locking slot 21 and the second locking slot 22 can receive the first set of beads 14 and the second set of beads 17, if desired. This arrangement provides the most versatility in bundling schemes. In other embodiments, the locking slots 12 and 22 can be particularly sized to receive either the beads 14 or the beads 17, based on the size and/or shape of the beads 14 and the beads 17. This alternate arrangement provides fewer bundling options, but may present an easy guide for some bundling applications. The first option will be assumed for this portion of the discussion, such that descriptions relating to slot 21 also apply to slot 22, unless specifically noted.

An enlarged opening 32 is provided at a generally central location within the slot 21. The enlarged opening 32 is sized to allow the beads 14 and/or 17 to pass through, so that the strand 12 can be threaded through the slot 21. The slot 21 leads from the enlarged opening 32 to a reduced-sized opening 33 on both ends of the slot 21 (e.g., on either side of the enlarged opening 32, convenient to the orientation of the slot 21).

An intermediate necked-down section 34 is provided between the enlarged opening 32 and the reduced openings 33. For instance, the necked-down section 34 is formed by reducing the width of the slot 21 between the enlarged opening 32 and the reduced openings 33. Additional material may be disposed in the slot 21 between the enlarged opening 32 and the reduced openings 33 to form the necked-down section 34. In an example, the necked-down section 34 comprises one or more wedge-shaped formations within and protruding into the narrow slot (21 and 22).

The reduced openings 33 are approximately the same diameter as the strand 12 (as between the beads 14 and/or between the beads 17). This allows the strand 12 to fit within the reduced openings 33, but does not allow the beads 14 or 17 to pass through the reduced openings 33. Thus, when the strand 12 is positioned within one of the reduced openings 33, the strand 12 is in a locked position at that opening 33. The necked-down section 34 reduces the opening size (e.g., width) of the slot 21 to a dimension less than the strand 12 diameter (or width). Thus, the strand 12 may be selectively snapped into a reduced opening 33 and locked in position within the locking slot 21. This means passing the strand 12 through the enlarged opening 32 and moving the strand 12 into one of the reduced openings 33 (by passing the strand 12 through one of the necked-down sections 34).

Referring to FIG. 7, in some embodiments, the slot 21 may include beveled sections 72 surrounding the reduced openings 33. The beveled sections 72 comprise a cup-like area for the beads 14 and/or 17 to fit within while the strand 12 is locked into a reduced opening 33. In some cases, the beveled sections 72 can guide the beads 14 and/or 17 into the locked position, and in other cases the beveled sections 72 can help to hold the beads 14 and/or 17 in the locked position at the reduced opening 33. In some examples, the beveled sections 72 are present on both sides of the tab 20, or rather both sides of the reduced openings 33 in the tab 20.

Several advantages of the double-sided locking slots 21 and 22 are noted here, and the person having skill in the art will recognize many others. Double-sided locking slots 21 and 22 each have at least two reduced openings 33, which are disposed on either side of an enlarged opening 32, with corresponding at least two necked-down sections 34 per slot (21 and 22). While the at least two reduced openings 33 are shown at opposite ends of a generally horizontal locking slot (21 and 22) in the drawings (e.g., about 180 degrees from each other), in alternate embodiments, the at least two reduced openings 33 may be at another angle with respect to each other and relative to the enlarged opening 32. For instance, the at least two reduced openings 33 may be at 90 degree angles to each other, relative to the enlarged opening 32, or some other angle.

Double-sided locking slots 21 and 22 allow the beaded strand 12 to be locked in at least two directions for each slot 21 and 22, for a total of four locking positions (with 2 slots) that may be used in any combination for a given application. In one example, the strand 12 may be wrapped around a portion of the bundle or load and locked in a first position (i.e., one of the reduced openings 33) at one locking slot 21 or 22, with the first position selected to conform to an expansion force of the bundle or load or selected to form the tightest grip on the bundle or load, for example. The strand 12 may then be wrapped around another portion of the bundle or load and locked in the second position at the same locking slot 21 or 22, or be locked in a first or second position at another locking slot 21 or 22. Of course, the strand 12 may continue to be wrapped around the bundle or load additional times, and locked in positions within the locking slots 21 and 22 until the length of the strand 12 is reached or the number of available positions is exhausted.

As mentioned, a locking position (i.e., reduced opening 33) may be selected to conform to forces exerted by the bundle or load, so that those forces act to keep the strand 12 secured in the locked position rather than acting to release the strand 12 from the locked position. For example, if the diameter of a compressible load is reduced by the application of the tie 10 around the diameter, the compression of the load materials can exert an outward force on the strand 12 as the load works to expand to its original diameter. If this outward force is sufficient, the strand 12 may be released from a locked position within a reduced opening 33 that is inboard of the enlarged opening 32. Accordingly, the strand 12 can be locked into a reduced opening 33 that is outboard of the enlarged opening 32, so that the exerted outward forces act to push the strand 12 in the locked position.

Additionally, multiple locking positions as described herein can prevent a tie 10 from releasing a bundle in a "jarring" event. If a tied bundle is dropped, jarred, bumped, etc. the strand 12 may come loose from a reduced opening 33 where it was locked. However, the force of the jarring event can cause the strand 12 to move into the opposite reduced opening 33 of the locking slot 21 or 22, retaining the bundle.

Further, a bundle can be contained and sorted or grouped with a single tie 10. In an example of a tie 10 with two double-sided locking slots 21 or 22, the four total locking positions can be used to contain as well as sort or group the elements of the bundle. The bundle can be wrapped with multiple loops of the strand 12, with different portions of the bundle grouped in the subsequent loops of the tie 10, and locked in different locking positions (i.e., reduced opening 33). Portions of the bundle can be released without releasing the entire bundle by unlocking the strand 12 from some but not all of the locking positions. This can also allow two or more unique but related items to be bundled in groups using the same tie 10. One or more loops can be disengaged, allowing some but not all items to be removed, or to allow items to be added to particular groups. The various loops of the strand 12 can be disengaged and relocked as many times as desired.

It can be desirable for the tie 10 to be somewhat permanently attached to a cord or other structure to be bundled using the locking slot 21, and not need to be removed generally. However, disengaging the strand 12 and the beads 14 or 17 from the locking slot 21 is accomplished by applying sufficient force to the strand 12 to compress the strand 12 through the necked-down section 34 and thereby allow disengagement of the strand 12 from the tab 20. The strand 12 may be moved within the enlarged opening 32, to be adjusted or to be removed from the tab 20 through the enlarged opening 32.

In some arrangements, the first locking slot 21 may be used to lock the tie 10 to a cord or other structure to be bundled, and the second locking slot 22 may be used to wrap around the bundle. In such an arrangement, the first set of beads 14 may be used with the locking slot 21, as the first portion of the strand 15 is wrapped around the cord, and the second set of beads 17 may be used with the locking slot 22 as the remainder portion of the strand 18 is wrapped around the bulk of the bundle. However, there are many and varied other applications for the tie 10, where either of the beads 14 and/or 17 may be used with the locking slots 21 or 22.

Thus, the second locking slot 22 may be generally the same in components, construction, and operation as the first locking slot 21. In alternate embodiments, the second locking slot 22 may be sized or shaped differently than the first locking slot 21 to accommodate different sizes or shapes of beads (14 or 17), for example.

Referring to FIGS. 3 and 4A-4C, in some embodiments, the dimensions of the strand 12, the beads 14 and/or 17, the tab 20, or the slots 21 and/or 22 may vary. For instance, the tie 10 may be configured for use with a very small bundle, and the components of the tie 10 may be down-sized or reduced in one or more dimensions to accommodate the small bundle. For instance the length of the strand 12 may be between five inches and twelve inches, for example. Alternately, the tie 10 may be configured for use with a larger bundle, and the components of the tie 10 may be larger-sized or increased in one or more dimensions to accommodate the larger bundle. For instance the length of the strand 12 may be between twelve inches and twenty-four inches, for example. In alternate embodiments, the length of the tie 10 may be less than five inches or more than twenty-four inches.

Figure 6A:
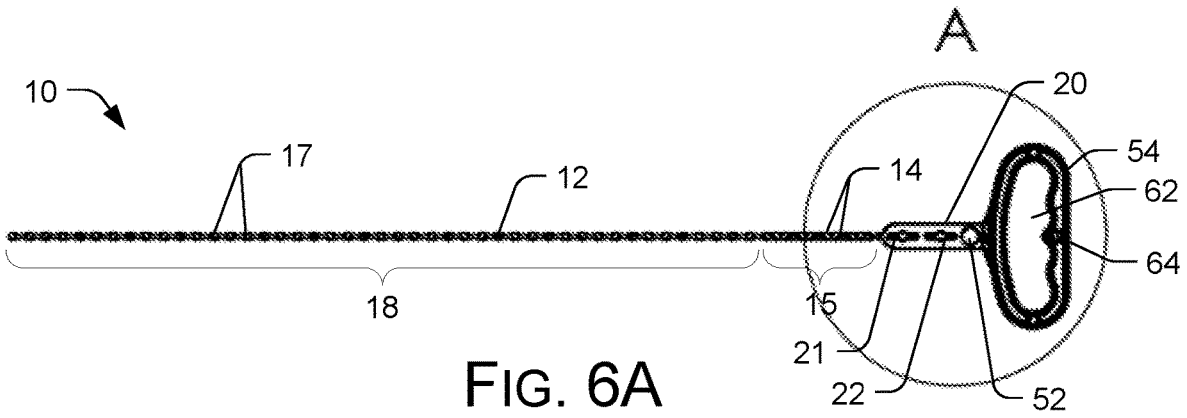
FIG. 6A shows a front plan view of the example releasable bundling tie of FIG. 5, according to the embodiment.
Figure 6B:
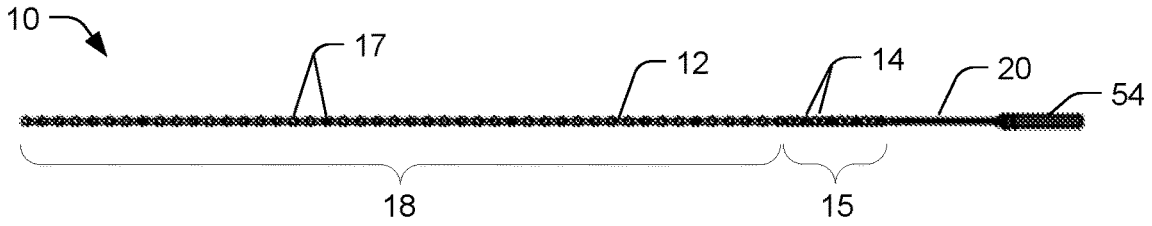
FIG. 6B shows a side view of the example releasable bundling tie of FIG. 5, according to the embodiment.
Figure 6C:
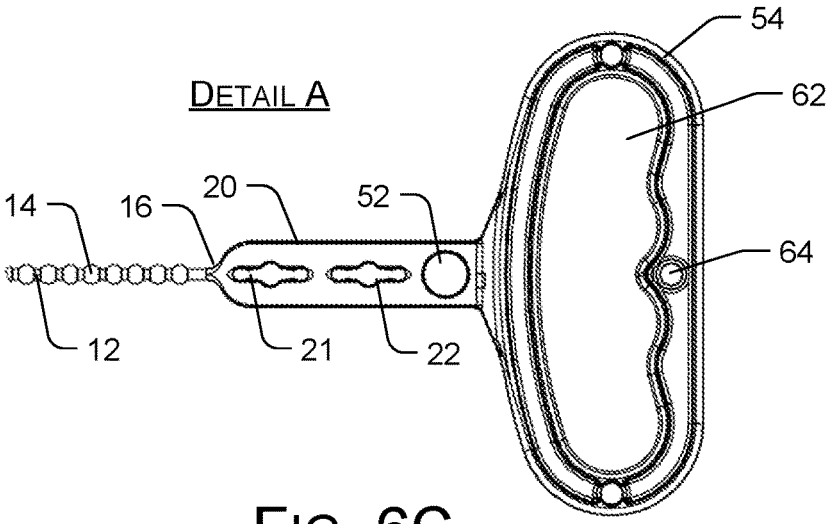
FIG. 6C shows a detail view of a portion of the example releasable bundling tie of FIG. 5, according to the embodiment.

Referring to FIGS. 5 and 6A-6C, in some embodiments, a carrying handle 54 may be provided on the tie 10. For instance, as shown at FIGS. 5 and 6A-6C, the handle 54 may be integral to the tie 10 at the tab 20 or the strand 12. The handle 54 may be formed of the same material as the remainder of the tie 10 and have sufficient dimension to allow insertion of one or more fingers for carrying purposes, or for enabling the tie 10 and engaged bundle to be hung. In some embodiments, as shown at FIG. 6C, the handle 54 may include an opening 62 to accommodate one or more fingers, as well as include one or more openings 64 to allow the tie 10 to be hung by the handle 54.

In an implementation, the handle 54 is constructed as a continuous I-beam for greater strength. In other words, the cross-section of the handle 54 resembles an I-beam, with the horizontal portions of the "I" having a significant width and thickness relative to the height of the vertical portion. Under normal loading, the handle 54 will resist deformation or will not deform. Formed into a generally elliptical shape, in one example, the handle 54 includes four detents (also with the I-beam construction) configured to receive four fingers of a hand. This allows the handle to be strong and comfortable, so that it is easily carried for long periods of time.

Example of Operation

An example operation of the tie 10 is herein described with reference to the drawings. The examples described identify a bundled workpiece such as a cord, tubing, or hose, but can also be applicable to other workpieces.

When it is desired to attach the tie 10 in a semi-permanent relationship to a cord, for example, the first set of beads 14 and the first locking slot 21 can be used to secure the tie 10 to one portion of the cord. The first length 15 can be looped around the cord and the strand 12 can be inserted through the enlarged opening 32 of the first locking slot 21. The loop of the strand 12 is pulled snug about the cord until the beads 14 of the first set engage and indent or firmly grip the cord. The strand 12 is locked in the locking slot 21 by moving the strand 12 into and through the necked down section 34 to snap into a reduced opening 33. Since the beads 14 and 17 are larger than the reduced opening 33, there is little danger that the tie 10 will slip loose from the firmly engaged orientation.

When it is desired to secure a bundle with the tie 10 (for instance the rest of the cord), a second loop of the strand 12 may be made around the bundle by extending the second portion 18 around the bundled material and inserting the strand 12 through the enlarged opening 32 of the first 21 or second locking slot 22. The strand 12 is pulled through the slot 21 or 22 until the bundle is firmly gripped. The strand 12 is then moved from the enlarged opening 32, through the necked down portion 34, and into the other reduced opening 33 of the first locking slot 21 or either reduced opening 33 of the second locking slot. This is again a form of snap fit. The strand 12 will not move longitudinally once locked in position since the beads 14 and 17 are significantly larger than the reduced opening 33. Thus, the bundle is secured. The hanger hole 52 may be utilized if desired to hang the secured bundle as desired.

Should the user wish to gain access to the bundled material, he or she need only to snap the strand 12 laterally from engagement within the reduced opening 33 back through the necked down portion 34 and into the enlarged opening 32. The strand 12 may then be pulled from engagement with the selected second locking slot 21 or 22, thereby opening the second loop and freeing the bundle for use.

The first loop, formed by the tab 20 and first strand length 15 will stay in engagement with the single portion of the material, with the second length 18 and locking slots 21 and 22 awaiting further use should it be desired to once again secure the material in a bundle form. The tie 10 is thus readily re-usable.

Operation as indicated above is similar, if not, identical with versions including the handle 54. In embodiments including an integral handle 54, the same procedures may be used for connecting the tie 10 to an article, then attachment of the tie 10 to a bundle or other arrangement of one or more workpieces. The handle 54 then becomes available for carrying or hanging the secured bundle.

It is noted that tension applied along the strand 12 can produce a shearing force against the portion of the bead 14 or 17 engaged at the associated reduced opening 33 of the tab 20. The fillets 48 and bead structure serve to strengthen the bead 14 or 17 against shearing. This is an advantage over ties which may include serrations or indentations that reduce the dimension of the strap or tie material and therefore create stress risers at which the ties may break when under tension.

In addition, the somewhat spherical configuration of the beads 14 or 17 is advantageous in that the bead surfaces have a tendency to indent and grip against the engaged article. Thus, there is less of a tendency for the present tie 10 to migrate or shift along the engaged article.

In alternate implementations, other techniques may be included in the process in various combinations, and remain within the scope of the disclosure.

CONCLUSION

Although the implementations of the disclosure have been described in language specific to structural features and/or methodological acts, it is to be understood that the implementations are not necessarily limited to the specific features or acts described. Rather, the specific features and acts are disclosed as representative forms of implementing the disclosed techniques, systems, and devices. Further, individual features of various embodiments may be combined to form other embodiments not specifically described.

What is claimed is:

1. An apparatus forming a bundling tie, comprising:

a locking tab having a first locking slot and a second locking slot, each locking slot comprising an enlarged opening with at least two reduced openings conjoined to the enlarged opening, each by a narrow opening, for a total of at least four reduced openings that comprise at least four locking positions;

a strand connected to or integral to the locking tab; and a plurality of three dimensional locking features spaced along the strand, wherein the at least four locking positions of the first locking slot and the second locking slot are each configured to engage with a three dimensional locking feature on the strand simultaneously to form a plurality of tie loops configured to securely engage and hold a bundle for transport or storage.

2. The apparatus of claim 1, further comprising a handle integral to or connected to the locking tab.

3. The apparatus of claim 2, further comprising at least one hanging hole disposed through the handle.

4. The apparatus of claim 1, further comprising at least one hanging hole disposed through the locking tab.

5. The apparatus of claim 1, further comprising a reinforcement portion disposed between the locking tab and the strand that gradually tapers the shape of the locking tab to match the shape of the strand.

6. The apparatus of claim 1, each locking slot further comprising a necked down section between the enlarged opening and one or more of the at least four reduced openings conjoined to the enlarged opening.

7. The apparatus of claim 6, wherein the necked down section comprises one or more wedge-shaped formations within and protruding into the narrow opening.

8. The apparatus of claim 6, wherein the necked down section has a dimension less than a diameter or width of the strand.

9. The apparatus of claim 6, wherein each locking slot includes two necked down sections and wherein each necked down section defines a portion of the shape of one of the at least four reduced openings.

10. The apparatus of claim 6, wherein a diameter of each of the at least four reduced openings is less than a diameter of the three dimensional locking features.

11. The apparatus of claim 1, wherein a diameter of the enlarged opening is greater than a diameter of the three dimensional locking features.

12. The apparatus of claim 1, wherein each of the at least four reduced openings includes a beveled or cupped portion at an outer perimeter of the at least four reduced openings.

13. The apparatus of claim 1, wherein the strand includes a first portion having a first set of three dimensional locking features with a first spacing and a second portion having a second set of three dimensional locking features with a second, different spacing.

14. The apparatus of claim 13, wherein the three dimensional locking features of the first set are disposed more closely together on the strand than the three dimensional locking features of the second set.

15. An apparatus forming a bundling tie, comprising:

a locking tab having a first locking slot and a second locking slot, each locking slot comprising an enlarged opening with at least two reduced openings conjoined to the enlarged opening, each by a narrow opening, for a total of at least four reduced openings that comprise at least four locking positions;

a strand connected to or integral to the locking tab; and a plurality of three dimensional locking features integral to the strand and fixed in a predetermined spacing along the strand, wherein the at least four locking positions of the first locking slot and the second locking slot are each configured to engage with a three dimensional locking feature on the strand to form a plurality of tie loops configured to securely engage and hold a bundle for transport or storage.

16. The apparatus of claim 15, further comprising a carry handle formed from a same material as the locking tab and formed integral to the locking tab.

17. The apparatus of claim 15, wherein each of the at least four reduced openings includes a beveled or cupped portion at an outer perimeter of the at least four reduced openings configured to fit an outer shape of the three dimensional locking features.

18. The apparatus of claim 15, wherein the three dimensional locking features are capable of passing through the enlarged opening but are incapable of passing through the reduced openings.

19. The apparatus of claim 15, wherein the strand includes a plurality of sections along a length of the strand, and wherein each section of the plurality of sections includes a subset of the plurality of three dimensional locking features, with each subset of three dimensional locking features having a relative spacing different from the relative spacing of an adjacent subset.

20. An apparatus forming a bundling tie, comprising:

a locking tab having a first locking slot and a second locking slot, each locking slot comprising an enlarged opening with at least two reduced openings conjoined to the enlarged opening, each by a narrow opening having one or more wedge-shaped formations within and protruding into the narrow opening, for a total of at least four reduced openings that comprise at least four locking positions;

a strand integral to the locking tab via a reinforcement portion that gradually tapers the shape of the locking tab to match the shape of the strand; and a plurality of three dimensional locking features integral to the strand and fixed in a predetermined spacing along the strand, wherein the at least four locking positions of the first locking slot and the second locking slot are each configured to engage with a three dimensional locking feature on the strand to form a plurality of tie loops configured to securely engage and hold a bundle for transport or storage.

* * * * *